US010818462B2

(12) United States Patent
Tetik et al.

(10) Patent No.: US 10,818,462 B2
(45) Date of Patent: Oct. 27, 2020

(54) CIRCUIT BREAKER

(71) Applicant: EATON INTELLIGENT POWER LIMITED, Dublin (IE)

(72) Inventors: Adolf Tetik, Vienna (AT); Alfred Nyzner, Vienna (AT)

(73) Assignee: EATON INTELLIGENT POWER LIMITED, Dublin (IE)

( * ) Notice: Subject to any disclaimer, the term of this patent is extended or adjusted under 35 U.S.C. 154(b) by 176 days.

(21) Appl. No.: 16/086,613

(22) PCT Filed: Mar. 22, 2017

(86) PCT No.: PCT/EP2017/056748
§ 371 (c)(1),
(2) Date: Sep. 20, 2018

(87) PCT Pub. No.: WO2017/162703
PCT Pub. Date: Sep. 28, 2017

(65) Prior Publication Data

US 2019/0103242 A1 Apr. 4, 2019

(30) Foreign Application Priority Data

Mar. 22, 2016 (DE) ..... 10 2016 105 341

(51) Int. Cl.
*H01H 50/54* (2006.01)
*H01H 71/40* (2006.01)
(Continued)

(52) U.S. Cl.
CPC ..... *H01H 71/402* (2013.01); *H01H 71/16* (2013.01); *H01H 71/2463* (2013.01);
(Continued)

(58) Field of Classification Search
CPC ..... H01H 71/16; H01H 71/40; H01H 71/402; H01H 71/2463; H01H 71/7436; H01H 71/48
(Continued)

(56) References Cited

U.S. PATENT DOCUMENTS 2,162,577 A * 6/1939 Gano ..... H01H 71/40 335/9
2,587,342 A * 2/1952 Lincks ..... H01H 73/34 335/23
(Continued)

FOREIGN PATENT DOCUMENTS

AT 512262 A1 6/2013
DE 2504954 B2 8/1976
(Continued)

*Primary Examiner* — Shawki S Ismail
*Assistant Examiner* — Lisa N Homza
(74) *Attorney, Agent, or Firm* — Leydig, Voit & Mayer, Ltd.

(57) ABSTRACT

A circuit breaker includes a short-circuit trip and an overcurrent trip. The short-circuit trip has a trip coil, and the overcurrent trip has a bimetallic element. A first terminal of the trip coil is conductively connected to a fixed contact carrier of the circuit breaker. The bimetallic element is connected in series with the trip coil. The bimetallic element is connected at least indirectly to a first connection terminal of the circuit breaker, and the first connection terminal is connected to the fixed contact carrier by a bypass line.

9 Claims, 3 Drawing Sheets

(51) Int. Cl.
*H01H 71/24* (2006.01)
*H01H 71/74* (2006.01)
*H01H 71/16* (2006.01)
*H01H 71/48* (2006.01)

(52) U.S. Cl.
CPC ..... *H01H 71/40* (2013.01); *H01H 71/48* (2013.01); *H01H 71/7436* (2013.01); *H01H 2071/749* (2013.01)

(58) Field of Classification Search
USPC ..... 335/2
See application file for complete search history.

(56) References Cited

U.S. PATENT DOCUMENTS 2,732,455 A * 1/1956 Ericson et al. ..... H01H 71/405 335/37
2,744,979 A * 5/1956 Bank ..... H01H 71/40 335/35
2,842,718 A * 7/1958 Smith ..... H01H 83/20 361/32
2,895,028 A * 7/1959 Ellenberger ..... H01H 73/56 335/24
2,994,753 A * 8/1961 Astleford, Jr. ..... H01H 71/68 335/26
3,161,747 A * 12/1964 Cole ..... H01H 71/40 337/71
3,171,928 A * 3/1965 Powell ..... H01H 71/52 337/73
3,211,862 A * 10/1965 Ellenberger ..... H01H 73/306 337/47
3,313,898 A 4/1967 Owen
3,365,682 A * 1/1968 Fujita ..... H01H 73/56 335/17
3,369,202 A * 2/1968 Gryctko ..... H01H 83/20 335/9
3,440,580 A * 4/1969 Molenaar ..... H01H 83/144 335/18
3,454,917 A * 7/1969 Howard ..... H01H 71/16 337/39
3,506,941 A * 4/1970 Shaffer ..... H01H 71/164 337/106
3,594,668 A * 7/1971 Clarke ..... H01H 9/38 335/13
3,599,135 A * 8/1971 Gryctko ..... H01H 9/10 337/236
3,908,110 A * 9/1975 Heft ..... G01R 35/005 219/121.69
3,953,812 A * 4/1976 Heft ..... H01H 69/01 335/23
3,958,197 A * 5/1976 Gryctko ..... H01H 83/22 335/18
3,959,755 A * 5/1976 Harper ..... H01H 71/34 335/63
4,000,444 A * 12/1976 Douglas ..... H01H 73/08 361/45
4,034,322 A 7/1977 Canonne
4,057,716 A * 11/1977 Canonne ..... G05G 7/02 200/401
4,325,041 A * 4/1982 Murai ..... H01H 71/04 335/16
4,366,354 A * 12/1982 Norden ..... H01H 71/529 200/457
4,484,165 A * 11/1984 Grenier ..... H01H 50/32 335/165
4,516,098 A * 5/1985 Krasser ..... H01H 71/1027 335/191
4,531,172 A * 7/1985 Mertz ..... H01H 83/20 335/6
4,535,309 A * 8/1985 Moreau ..... H01H 71/7463 335/42
4,609,799 A * 9/1986 Ohishi ..... H01H 71/526 200/318
4,616,200 A * 10/1986 Fixemer ..... H01H 71/524 335/35
4,628,288 A * 12/1986 Fujihisa ..... H01H 71/526 200/401
4,641,001 A * 2/1987 Fujihisa ..... H01H 71/526 200/318
4,644,312 A * 2/1987 Baines ..... H01H 71/345 335/236
4,700,160 A * 10/1987 Belbel ..... H01H 3/0253 335/14
4,752,660 A * 6/1988 Yokoyama ..... H01H 9/32 218/117
4,855,698 A * 8/1989 Cohen ..... H01H 89/08 335/14
4,855,701 A * 8/1989 Yokoyama ..... H01H 51/2209 335/230
4,897,625 A * 1/1990 Yokoyama ..... H01H 51/2209 335/14
4,973,928 A * 11/1990 Grunert ..... H01H 71/7463 335/176
5,164,693 A * 11/1992 Yokoyama ..... H01H 9/46 335/14
5,245,302 A * 9/1993 Brune ..... H01H 71/405 335/23
5,614,878 A * 3/1997 Patrick ..... H01H 83/20 335/14
5,872,495 A * 2/1999 DiMarco ..... H01H 71/164 335/22
5,946,179 A * 8/1999 Fleege ..... G01R 31/50 361/42
6,034,586 A * 3/2000 Runyan ..... H01H 71/1027 218/152
6,201,460 B1 * 3/2001 Winslett ..... H01H 83/12 335/132
6,255,925 B1 * 7/2001 DiMarco ..... H01H 71/7463 335/176
2002/0057146 A1 * 5/2002 McMillan ..... H04B 3/54 335/35
2002/0079291 A1 * 6/2002 Beck ..... H01H 71/52 218/140
2002/0196108 A1 * 12/2002 Millburn ..... H01H 73/38 335/6
2003/0038692 A1 * 2/2003 Schmalz ..... H02H 1/06 335/35
2003/0043522 A1 * 3/2003 Schmalz ..... H01H 71/16 361/105
2004/0227602 A1 * 11/2004 Ciarcia ..... H01H 71/2472 335/172
2005/0230231 A1 * 10/2005 Kadan ..... H01H 9/0264 200/51 R
2007/0268097 A1 * 11/2007 Elviro ..... H01H 71/0207 335/6
2007/0268098 A1 * 11/2007 Ghosh ..... H01H 71/002 335/6
2008/0018422 A1 * 1/2008 Claeys ..... H01F 1/0308 335/35
2008/0117006 A1 * 5/2008 Claeys ..... H01H 71/40 335/35
2008/0157904 A1 * 7/2008 Dominguez ..... H01H 71/1045 335/11
2009/0224864 A1 * 9/2009 Tetik ..... H01H 71/7427 337/372
2009/0260967 A1 * 10/2009 Tetik ..... H01H 71/2454 200/337
2010/0156576 A1 * 6/2010 Broghammer ..... H01H 83/20 335/35
2010/0264928 A1 * 10/2010 Zende ..... H01H 83/04 324/424
2012/0113557 A1 * 5/2012 Hengelein ..... H01H 71/0228 361/115
2012/0182095 A1 * 7/2012 Wendel ..... H01H 77/108 335/18
2012/0250206 A1 * 10/2012 Bonilla ..... H01H 83/226 361/102

(56) References Cited

U.S. PATENT DOCUMENTS

| | | | | |
|---|---|---|---|---|
| 2014/0333396 | A1* | 11/2014 | Tetik | H01H 71/16 335/35 |
| 2015/0243462 | A1* | 8/2015 | Augusta | H01H 50/18 335/176 |
| 2018/0218852 | A1* | 8/2018 | Weber | H01H 9/342 |
| 2018/0323027 | A1* | 11/2018 | Tomaselli | H01H 71/0207 |
| 2019/0189379 | A1* | 6/2019 | Ostrovsky | H01H 71/64 |

FOREIGN PATENT DOCUMENTS

| | | | |
|---|---|---|---|
| DE | 2928786 | A1 | 2/1981 |
| GB | 2055264 | A | 2/1981 |

* cited by examiner

CIRCUIT BREAKER

CROSS-REFERENCE TO PRIOR APPLICATIONS

This application is a U.S. National Stage Application under 35 U.S.C. § 371 of International Application No. PCT/EP2017/056748 filed on Mar. 22, 2017, and claims benefit to German Patent Application No. DE 10 2016 105 341.4 filed on Mar. 22, 2016. The International Application was published in German on Sep. 28, 2017 as WO 2017/162703 A1 under PCT Article 21(2).

FIELD

The invention relates to a circuit breaker.

BACKGROUND

Circuit breakers which automatically separate the switching contacts in the case of overcurrent and/or short-circuit current, and thus switch off a circuit arranged downstream, are known. Circuit breakers of this kind usually have an overcurrent trip including a bimetallic element and a short-circuit trip including a trip coil and a plunger that is movably arranged therein. There are two prevailing types of both the local arrangement and the electrical wiring of the two assemblies within a circuit breaker.

According to the first of the two types, the bimetallic element is connected in series with the trip coil. The two parts are arranged at different points within the circuit breaker. The present inventors have recognized that solutions of this kind are disadvantageous, in particular in the case of high current intensities, in that very thick connection lines are required within the circuit breaker in order to minimize the power loss and heating. Thick lines of this kind, which have to be in the form of flexible connection cables in regions, are very rigid, however, and can influence the behavior of the bimetal. The bimetal reacts relatively quickly to overcurrents in arrangements of this kind. This kind of design can be used in particular in circuit breakers for low current intensities, for example 16A.

In the second prevalent type, the bimetallic element is arranged in parallel with the trip coil both electrically and in terms of circuitry. In this case, the bimetallic element is subjected to the waste heat from the trip coil, which is why the element has to be designed to be relatively slow-acting, and, on account of the parallel connection, a low current simultaneously flows through the bimetallic element, which heats up to a lesser extent as a result. This kind of design is used in particular in circuit breakers for higher current intensities, for example 63A or 125A. The present inventors have recognized a disadvantage of circuit breakers designed in this way is the high response time in the case of overcurrents which are just below the response threshold of the magnetic trip device. This leads to excessive heating of the current-conducting parts, and can lead to adjacent plastics parts within the circuit breaker melting, as a result of which the functionality of the circuit breaker is impaired.

SUMMARY

An embodiment of the present invention provides a circuit breaker that includes a short-circuit trip and an overcurrent trip. The short-circuit trip has a trip coil, and the overcurrent trip has a bimetallic element. A first terminal of the trip coil is conductively connected to a fixed contact carrier of the circuit breaker. The bimetallic element is connected in series with the trip coil. The bimetallic element is connected at least indirectly to a first connection terminal of the circuit breaker, and the first connection terminal is connected to the fixed contact carrier by a bypass line.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Embodiments of the invention provide a circuit breaker by means of which the aforementioned disadvantages can be avoided, which also has a low response time in the case of overcurrents and exhibits a low degree of heating, and which can be manufactured with little expenditure on materials.

Embodiments of the present invention provide a circuit breaker which has a low response time of the bimetallic element in the case of higher overcurrents, which overcurrents are in particular below the response threshold of the short-circuit trip. As a result, the self-heating of the circuit breaker can be minimized, and damage to the circuit breaker caused in this way can be prevented. This means that the cross sections of the current-conducting conductors can be minimized, along with the weight of the circuit breaker and the expenditure on raw materials and transport.

The invention is described in more detail with reference to the accompanying drawings, in which merely preferred embodiments are shown by way of example.

Figure 1:
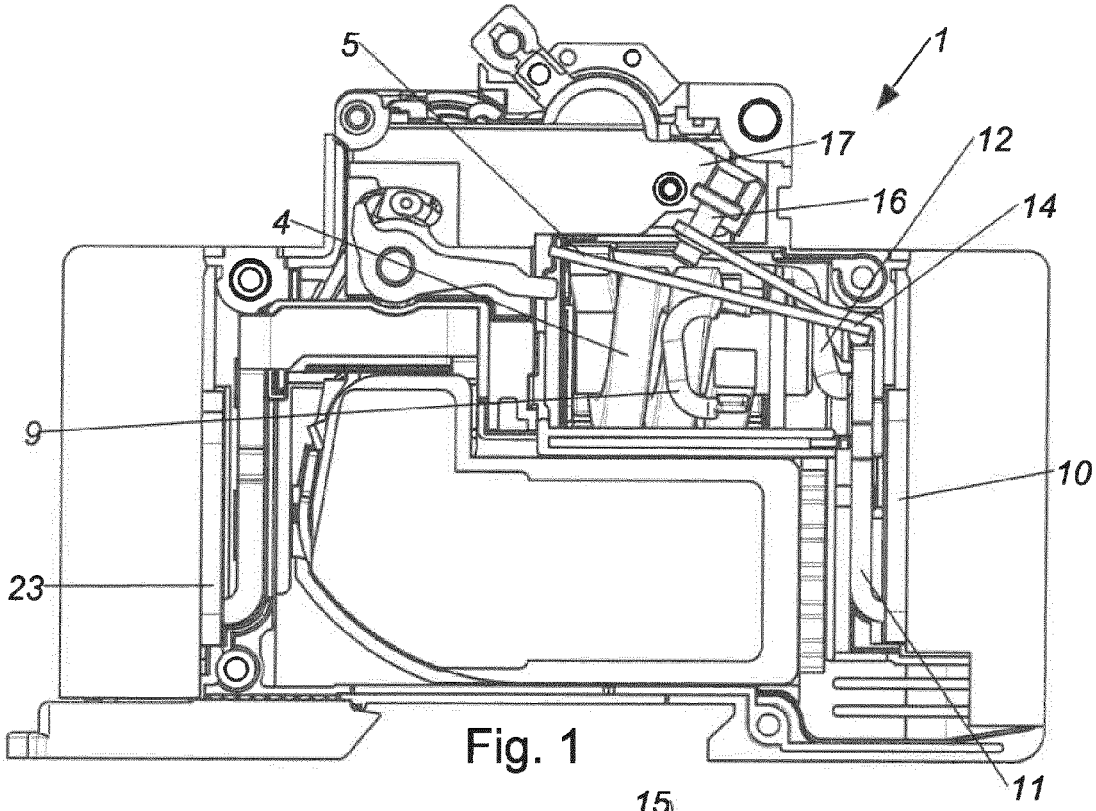
FIG. 1 is a front view of a circuit breaker according to the invention with the top of the housing removed.
Figure 2:
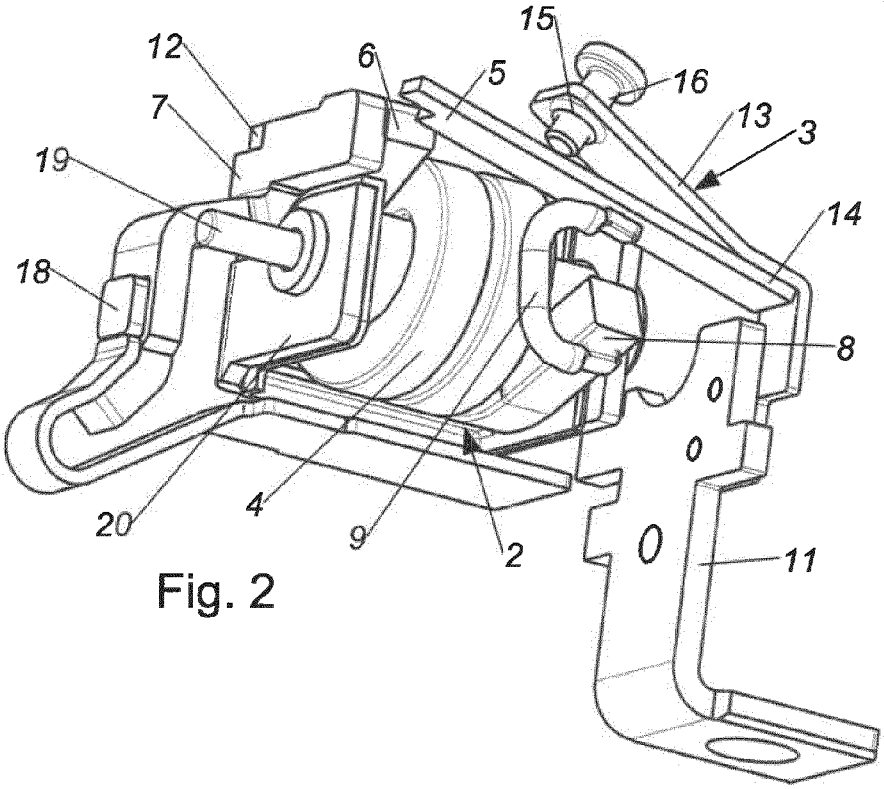
FIG. 2 is a first axonometric view of a trip assembly of the circuit breaker according to FIG. 1.
Figure 3:
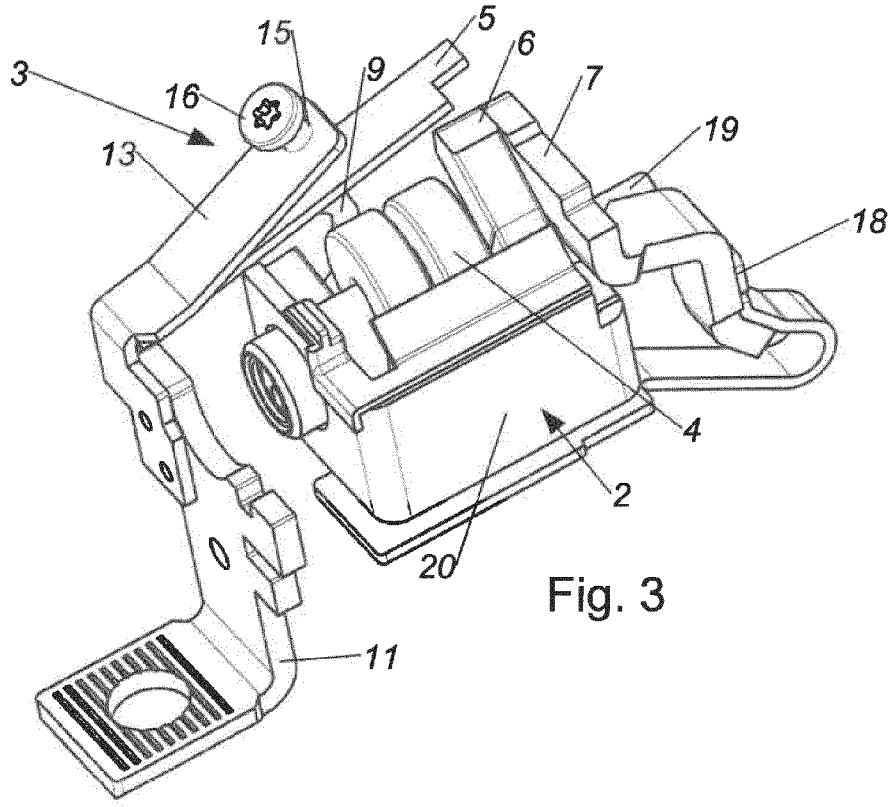
FIG. 3 is an axonometric view of the trip assembly according to FIG. 2 without a bypass line.
Figure 4:
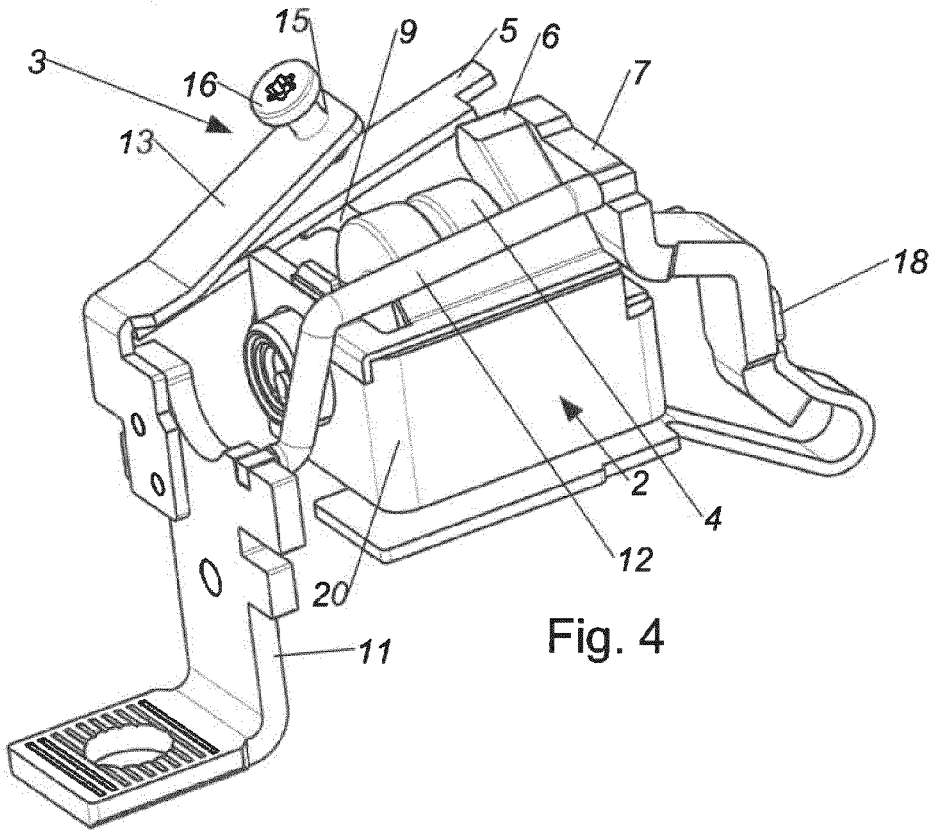
FIG. 4 is a second axonometric view of the trip assembly according to FIG. 2 with a bypass line.
Figure 5:
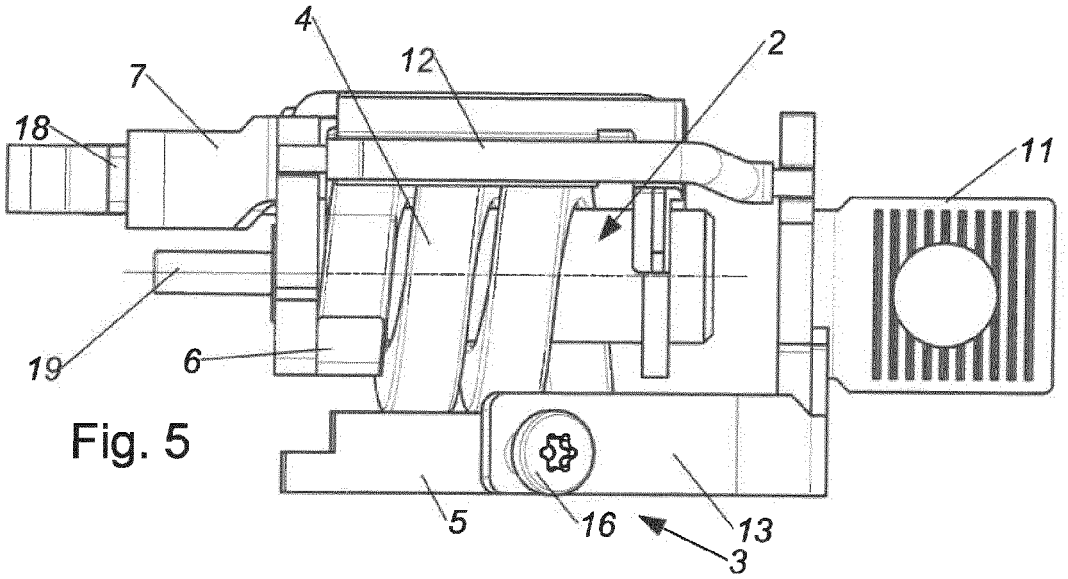
FIG. 5 is a plan view of the trip assembly according to FIG. 2.
Figure 6:
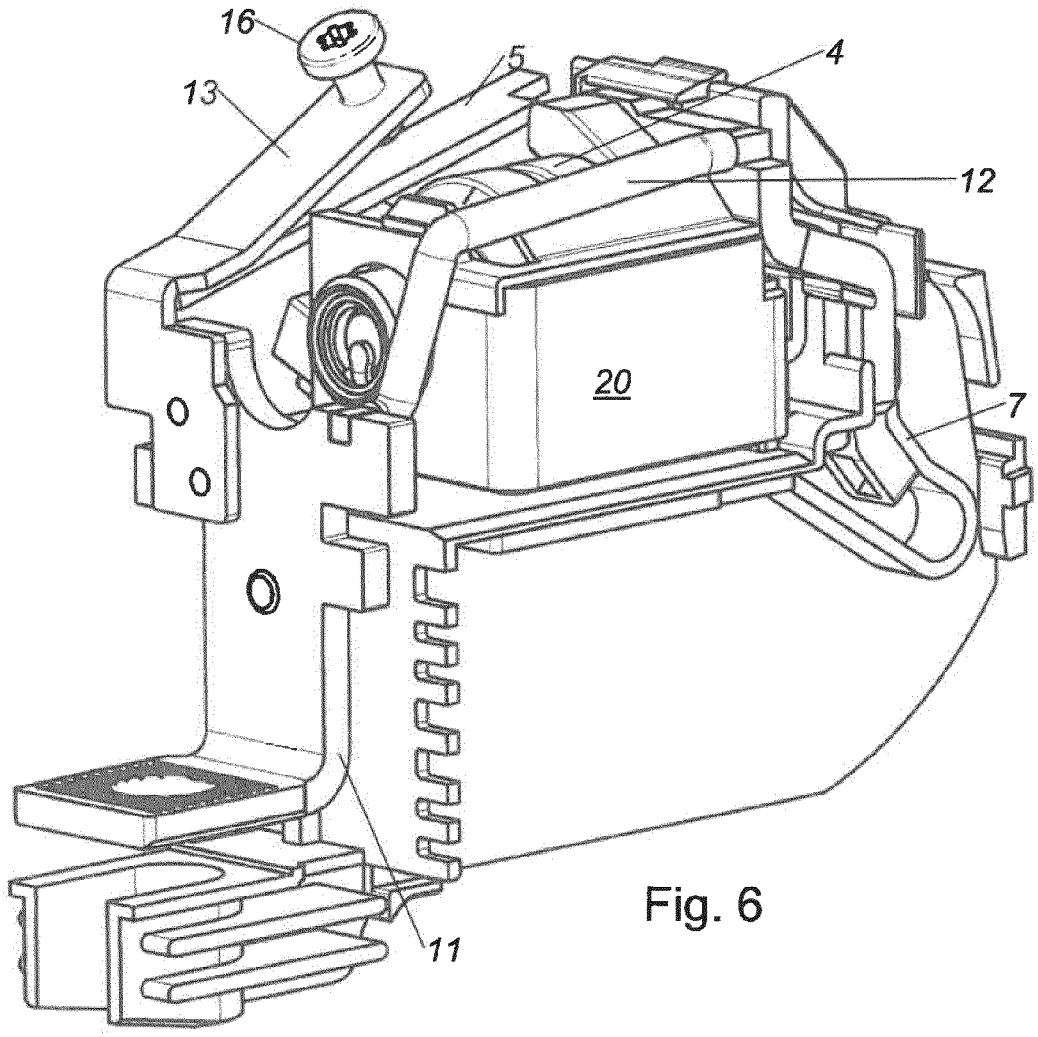
FIG. 6 is an axonometric view of the trip assembly according to FIG. 2 together with parts of an arc extinction device.

FIG. 1 shows a preferred embodiment of a circuit breaker 1 including a short-circuit trip 2 and an overcurrent trip 3, the short-circuit trip 2 having a trip coil 4 and the overcurrent trip 3 having a bimetallic element 5, a first terminal 6 of the trip coil 4 being conductively connected to a fixed contact carrier 7 of the circuit breaker 1, the bimetallic element 5 being connected in series with the trip coil 4, and the bimetallic element 5 being connected at least indirectly to a first connection terminal 10 of the circuit breaker 1, in particular being fastened to the first connection terminal 10, the first connection terminal 10, in particular a terminal bracket 11 of the first connection terminal 10, being connected to the fixed contact carrier 7 by means of a bypass line 12.

It is thus possible to provide a circuit breaker 1 which has a low response time of the bimetallic element 5 in the case of higher overcurrents, which overcurrents are in particular below the response threshold of the short-circuit trip 2. As a result, the self-heating of the circuit breaker 1 can be minimized, and damage to the circuit breaker 1 caused in this way can be prevented. This means that the cross sections of the current-conducting conductors can be minimized, along with the weight of the circuit breaker 1 and the expenditure on raw materials and transport.

The circuit breaker 1 according to the invention has a short-circuit trip 2 and an overcurrent trip 3, and is therefore provided for protecting electrical systems from the effects of short-circuits and overcurrents, respectively. The terms "short-circuit" and "overcurrent" are known from applicable regulations.

The circuit breaker 1 has switching contacts, with only one fixed contact 18 being shown in FIGS. 2 to 5. The circuit breaker 1 has at least one fixed contact 18 in this case, i.e. a switching contact that is stationary with respect to the housing of the circuit breaker 1, and one switching contact that is movable relative to the housing. The circuit breaker 1 according to the invention preferably has a "double break", with two fixed contacts 18 being provided, as well as a switching bridge having two contacts in order to connect the two fixed contacts 18.

In the case of a short-circuit or overcurrent, a latch (not shown) is triggered in a known manner, which in turn leads to the separation of the switching contacts and breaking of the flow of current over the circuit breaker 1, which current flows from a first connection terminal 10 to a second connection terminal 23 of the circuit breaker 1 when the switching contacts are closed.

The short-circuit trip 2 is designed to include a trip coil 4 in a known manner. The trip coil 4 is surrounded in regions by a yoke 20. A movably mounted trip plunger 19 is arranged inside the trip coil 4. The function of electromagnetic short-circuit trips 2 of this kind is known per se.

The overcurrent trip 3 has a bimetallic element 5 in a known manner. The bimetallic element 5 is preferably heated when there is a direct current flow, but alternative or additional heating is also possible.

The overcurrent trip 3 and the short-circuit trip 2 are electrically interconnected in series. However, the two trips 2, 3 are not arranged so as to be spaced far apart from one another in the circuit breaker 1, as is conventional in other trips connected in series, but rather form a common structural unit. In this case, it is preferable for the bimetallic element 5 to be arranged within the circuit breaker 1 so as to be adjacent to the trip coil 4, substantially in parallel with a longitudinal extension of the trip coil 4.

A first terminal 6 or first end of the trip coil 4 is conductively connected to a fixed contact carrier 7 of the circuit breaker 1. In this case, it is preferable for the terminal in question of the trip coil 4 to be in direct contact with or directly connected to the fixed contact carrier 7.

A second terminal 8 or end of the trip coil 4 is preferably conductively connected to the bimetallic element 5 by means of a flexible conductor 9. In particular, the flexible conductor 9 is directly connected to the bimetallic element 5 by means of the second terminal 8 of the trip coil 4.

No further conductive parts are therefore provided between the bimetallic element 5 and the trip coil 4. As a result of the preferably locally proximal arrangement of the bimetallic element 5 and the trip coil 4, the flexible conductor 9 in question can be kept very short, as can also be seen in FIGS. 1 and 2.

The bimetallic element 5 is fastened at least indirectly to a first connection terminal 10 of the circuit breaker 1. It is preferable in this case for the bimetallic element 5 to be fastened to the terminal bracket 11 of the first connection terminal 10, or to be conductively connected thereto.

It is preferable in this case for an adjustment apparatus 13 for adjusting the bimetallic element 5 to be arranged on the first connection terminal 10, in particular on the terminal bracket 11, and for the bimetallic element 5 to be fastened to the adjustment apparatus 13 by means of a first bimetallic element end 14. Only part of the adjustment apparatus 13 is therefore arranged between the bimetallic element end 14 and the first connection terminal 10.

It is particularly preferable for the short-circuit trip 2, the overcurrent trip 3, the terminal bracket 11 of the first connection terminal 10 and the fixed contact carrier 7 to form a common structural unit, as is shown for example in FIGS. 2, 3, 4 and 5 for example. A structural unit of this kind is advantageous in that it can be assembled and even tested before installation in a circuit breaker 1. This results in simplified manufacture of a circuit breaker 1.

The adjustment apparatus 13 is formed substantially by a flat metal part which projects from the bimetal and in which a threaded opening 15 is arranged so as to be spaced apart from the bimetallic element 5, in which opening an adjustment screw 16 is arranged.

The adjustment screw 16 is mounted in a housing part 17 of the circuit breaker 1 in such a way that an angle between the adjustment apparatus 13 and the first connection terminal 10 is altered when the adjustment screw 16 is rotated. The housing part 17 in question is shown in FIG. 1. This is preferably an internal part made of an insulating material, and forms a sub-housing for parts of the latch or the switch position indicator.

The first connection terminal 10, in particular a terminal bracket 11 of the first connection terminal 10, is preferably connected to the fixed contact carrier 7 by means of a bypass line 12. A bypass line 12 of this kind is also referred to as a shunt in electrical engineering. The bypass line 12 allows the rated current region of the whole trip assembly or circuit breaker 1 to be increased. The bypass line 12 makes it possible for the rated current region to be practically doubled from 63 A to 125 A, for example.

Both the overcurrent trip and the short-circuit trip can be can be bridged or shunted by means of the bypass line 12 according to the invention.

As a result, on account of just a single further component, the field of application of the otherwise identical assembly consisting of the overcurrent trip 3 and the short-circuit trip 2 can be used for various circuit breakers 1 having various rated current regions, as a result of which manufacturing costs can be significantly reduced.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The invention claimed is:

1. A circuit breaker, comprising:

a fixed contact carrier;

a first connection terminal;

a bypass line;

a short-circuit trip comprising a trip coil having a first terminal; and an overcurrent trip comprising a bimetallic element, wherein the first terminal of the trip coil is conductively connected to the fixed contact carrier, wherein the bimetallic element is connected in series with the trip coil, wherein the bimetallic element is connected at least indirectly to the first connection terminal, and wherein the first connection terminal is connected to the fixed contact carrier by the bypass line.

2. The circuit breaker according to claim 1, wherein a second terminal of the trip coil is conductively connected to the bimetallic element by a flexible conductor.

3. The circuit breaker according to claim 1, wherein the bimetallic element is fastened to a terminal bracket of the first connection terminal.

4. The circuit breaker according to claim 1, wherein an adjustment apparatus for adjusting the bimetallic element is arranged on the first connection terminal, and wherein the bimetallic element is fastened to the adjustment apparatus by a first bimetallic element end.

5. The circuit breaker according to claim 4, wherein the adjustment apparatus has a threaded opening which is arranged so as to be spaced apart from the bimetallic element and in which an adjustment screw is arranged.

6. The circuit breaker according to claim 5, wherein the adjustment screw is mounted in a housing part of the circuit breaker in such that an angle between the adjustment apparatus and the first connection terminal is altered when the adjustment screw is rotated.

7. The circuit breaker according to claim 1, wherein the bimetallic element is arranged within the circuit breaker so as to be adjacent to the trip coil, substantially in parallel with a longitudinal extension of the trip coil.

8. The circuit breaker according to claim 1, wherein the bimetallic element is fastened to the first connection terminal.

9. The circuit breaker according to claim 1, wherein a terminal bracket of the first connection terminal is connected to the fixed contact carrier by the bypass line.

* * * * *